US005176690A

United States Patent [19]

Gross et al.

[11] Patent Number: 5,176,690

[45] Date of Patent: Jan. 5, 1993

[54] POWER-OPERATED TWEEZERS DEVICE

[75] Inventors: Joseph Gross, Moshav Mazor; Shlomo Zucker, Mihmoret, both of Israel

[73] Assignee: Product Development (Z.G.S.) Ltd., Petach Tikva, Israel

[21] Appl. No.: 801,197

[22] Filed: Dec. 2, 1991

[30] Foreign Application Priority Data

Dec. 4, 1990 [IL] Israel ..... 96540

[51] Int. Cl.[5] ..... A45D 26/00

[52] U.S. Cl. ..... 606/133; 606/1; 606/131

[58] Field of Search ..... 606/131, 133

[56] References Cited

U.S. PATENT DOCUMENTS

| | | | |
|---|---|---|---|
| 1,036,725 | 8/1912 | Sabo | 606/133 |
| 1,667,170 | 4/1928 | Segal | 606/133 |
| 1,991,816 | 2/1935 | Moseley | 606/133 |
| 2,025,006 | 12/1935 | Ubelhart et al. | 606/133 |
| 2,082,263 | 6/1937 | Schleimer | 606/133 |
| 2,113,962 | 4/1938 | Moir | 606/133 |
| 2,123,870 | 7/1938 | Wehmer | 606/133 |
| 2,592,484 | 4/1952 | Smith | 606/133 |
| 2,704,857 | 3/1955 | Fisher . | |
| 4,171,708 | 10/1979 | Walter et al. . | |
| 4,240,435 | 12/1980 | Yazawa et al. | 606/133 |

FOREIGN PATENT DOCUMENTS

| | | | |
|---|---|---|---|
| 0810749 | 3/1937 | France | 606/133 |

*Primary Examiner*—Stephen C. Pellegrino
*Assistant Examiner*—Glenn K. Dawson
*Attorney, Agent, or Firm*—Benjamin J. Barish

[57] ABSTRACT

A power-operated tweezers device for plucking hairs includes a reciprocatable member coupled to a motor, tweezers, a lost-motion coupling between the reciprocatable member and the tweezers effective to move the tweezers to an extended position only during a first part of the forward stroke of the reciprocatable member, and to a retracted position only during a first part of the return stroke of the reciprocatable member; and means effective to move the tweezer jaws to their closed positions during a last part of the forward stroke of the reciprocatable member, and to their open positions during a last part of the return stroke of the reciprocatable member.

17 Claims, 4 Drawing Sheets

POWER-OPERATED TWEEZERS DEVICE

FIELD AND BACKGROUND OF THE INVENTION

The present invention relates to a power-operated tweezers device for plucking hairs.

A number of power-operated tweezers devices are known in the patent literature, examples, being described in U.S. Pat. Nos. 4,171,701, 2,592,484, 2,123,860, 2,082,263 and 2,025,006 and in French Patent 1,393,532. The advantages of power-operated tweezers are well known, particularly the reduction in pain when the plucking is done quickly so as exceed the reaction time of the sensory nerve. Nevertheless, power-operated tweezers have not yet found widespread use probably because of the complicated construction generally involved in the previously described devices, and/or the inability of the device to pluck the hairs at a sufficiently high speed to reduce or eliminate the pain. In addition, most of the power-operated tweezer devices include but a single pair of jaws which makes the use of the device a slow and tedious operation.

OBJECTS AND BRIEF SUMMARY OF THE INVENTION

An object of the present invention is to provide a power-operated tweezers device having advantages in one or more of the above respects.

According to a broad aspect of the present invention, there is provided a power-operated tweezers device for plucking hairs, comprising: a motor fixed with respect to a base; a reciprocatable member coupled to said motor so as to be driven through a forward stroke to an extended position, and through a return stroke to a retracted position; tweezer means including a pair of arms having jaws movable to an open position to straddle a hair to be plucked, or a closed position to clamp the hair therebetween; a lost-motion coupling between said reciprocatable member and said tweezer means effective to move the tweezer means to an extended position only during a first part of the forward stroke of the reciprocatable member, and to a retracted position only during a first part of the return stroke of the reciprocatable member; and tweezer closing-opening means effective to move the tweezer jaws to their closed positions during a last part of the forward stroke of the reciprocatable member, and to their open positions during a last part of the return stroke of the reciprocatable member.

Two embodiments of the invention are described below for purposes of example. In both embodiments, the lost-motion connection includes a pin fixed to the base and received within a long slot formed in the reciprocatable member and a short slot formed in the tweezer means.

According to further features in both described embodiments, the motor is a rotary motor having a rotary shaft and is coupled to the reciprocatable member by an eccentric rotated by the rotary shaft. In addition, the rotary shaft rotates a worm gear meshing with a gear wheel eccentrically coupled to the reciprocatable member. More particularly, the reciprocatable member is a reciprocatable plate movable on the base and constrained to reciprocal movements by pins fixed to the base movable in slots formed in the plate.

In one described embodiment, each of the pair of arms of the tweezer means includes a single jaw.

In a second described embodiment, each of the pair of arms of the tweezer means carries a plurality of jaws, the jaws of one of the arms being openable and closable with respect to the jaws of the other arms.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
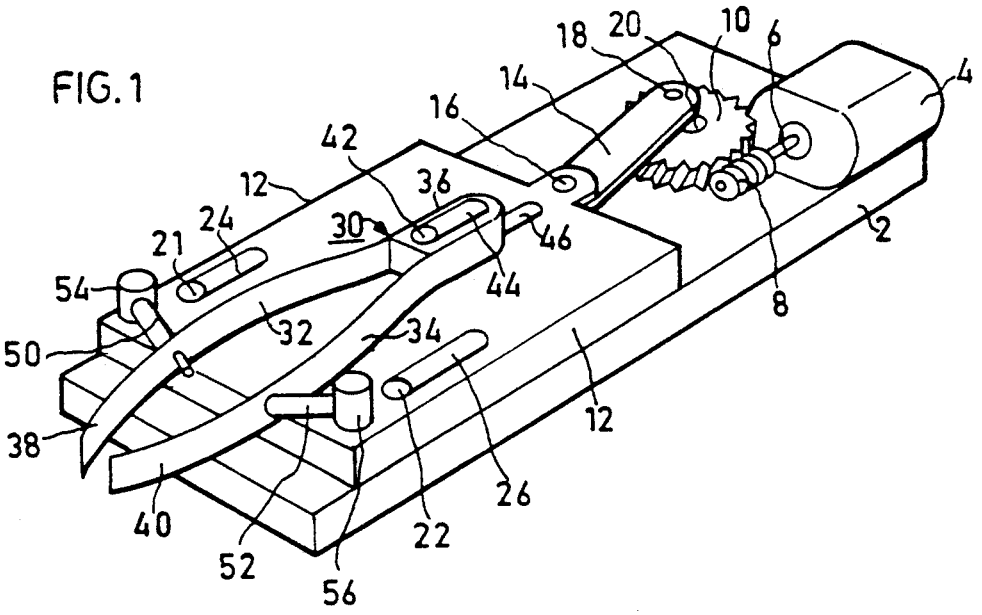
FIG. 1 is a three-dimensional view illustrating one form of power-operated tweezers device constructed in accordance with the present invention.

The Embodiment of FIGS. 1 and 2a–2d

The device illustrated in FIGS. 1 and 2*a*–2*d* comprises a base plate 2 supporting an electric rotary motor 4 whose rotary shaft 6 drives a worm gear 8 meshing with a gear wheel 10. A reciprocatable plate 12 is coupled to gear wheel 10 by a crank arm 14 pivotally connected at one end by pin 16 to the reciprocatable plate, and pivotally connected at its opposite end by pin 18 to gear wheel 10 eccentrically with respect to the center shaft 20 of the gear wheel. It will thus be seen that the operation of motor 4 will cyclically drive plate 12 through forward strokes to an extended position, and through return strokes to a retracted position. This movement of the plate 12 is constrained to reciprocatable movements by a pair of pins 21, 22 fixed to base plate 2 and movable within a pair of slots 24, 26 formed in reciprocatable plate 12.

A pair of tweezers, generally designated 30, is carried by reciprocatable plate 12 between the latter's slots 24, 26. Tweezers 30 include a pair of arms 32, 34 connected together at one end by a bridge section 36 and terminating at their opposite ends in jaws 38, 40. The tweezer arms 32, 34 are sufficiently elastic such that the two jaws 38, 40 may be moved to an open position in order to straddle a hair to be plucked, or to a closed position to clamp the hair between the jaws.

The tweezers 30 are coupled to the reciprocatable plate 12 by a lost-motion coupling, which includes a pin 42 fixed to the base plate 2 and movable within a short slot 44 formed in the bridge section 36 of the tweezers, and a long slot 46 formed in plate 12 aligned with slot 44 in the bridge section 36 of the tweezers. As will be described more particularly below, this lost-motion coupling is effective to move the tweezers 30 to an extended position only during a first part of the forward stroke of the reciprocatable plate 12, and to a retracted position only during a first part of the return stroke of the reciprocatable plate. Slots 24, 26 and 46 in the reciprocatable plate 12 are all of the same length, equal to the length of the forward and return strokes. Slot 44, however, in the bridge section 36 of the tweezers 30, is of substantially smaller length so that the tweezers will close just before the end of the forward stroke and will open just before the end of the return stroke. In the described example, slot 44 is one-half the length of slots 24, 26 and 46, so that the tweezers will close during the last half of the forward stroke and will open during the last half of the returns stroke.

The illustrated device further includes tweezer closing-opening means effective to move the tweezer jaws 38, 40 to their closed positions during the last part of the forward stroke of the reciprocatable plate 12, and to their open positions during the last part of the return stroke of the reciprocatable plate. Such tweezer closing-opening means comprises a pair of links 50, 52 pivotally mounted at their outer ends by pins 54, 56 to the reciprocatable plate 12, and coupled at their inner ends to the two arms 32, 34 of the tweezers.

Figure 2A:
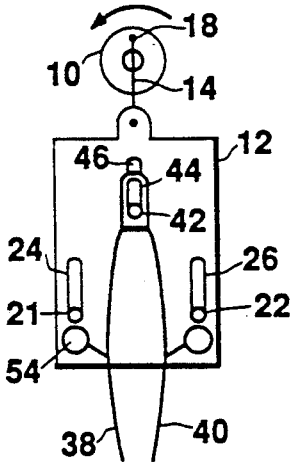
FIGS. 2*a*–2*d* illustrate the operation of the device of FIG. 1.
Figure 2B:
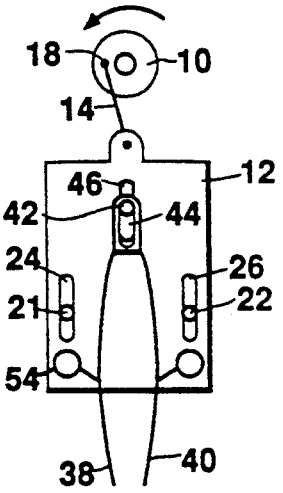
Figure 2C:
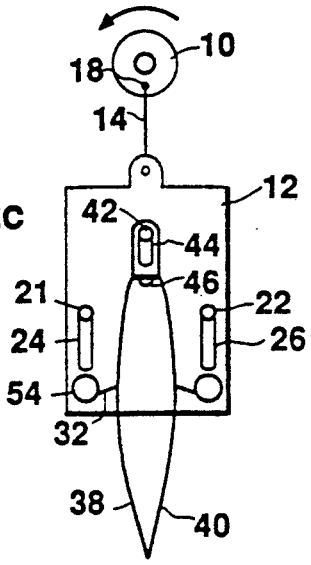
Figure 2D:
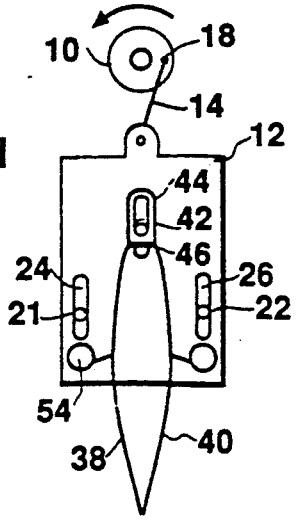
Figure 3:
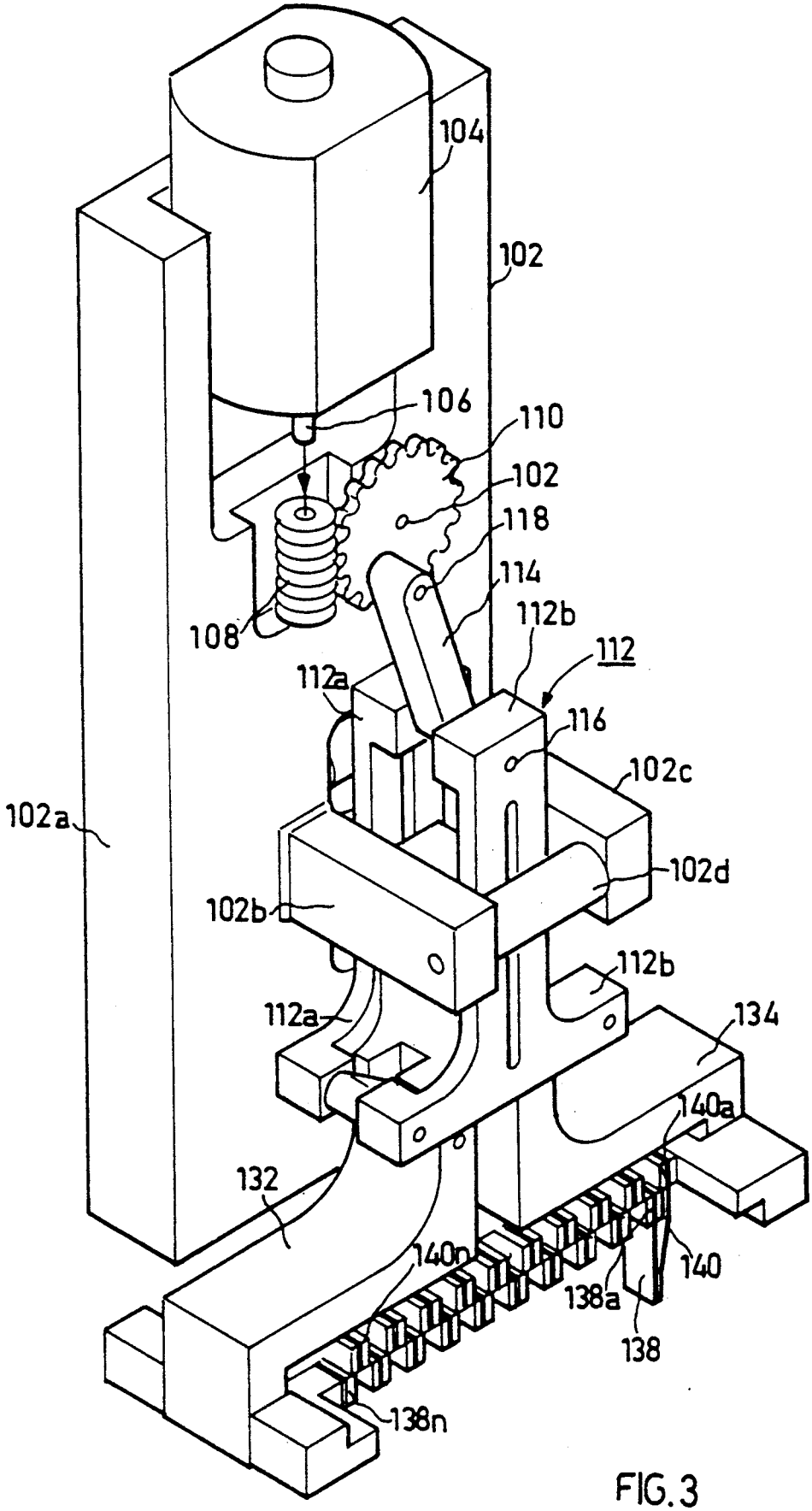
FIG. 3 is a three-dimensional view illustrating a second form of power-operated tweezer device constructed in accordance with the present invention.
Figure 4A:
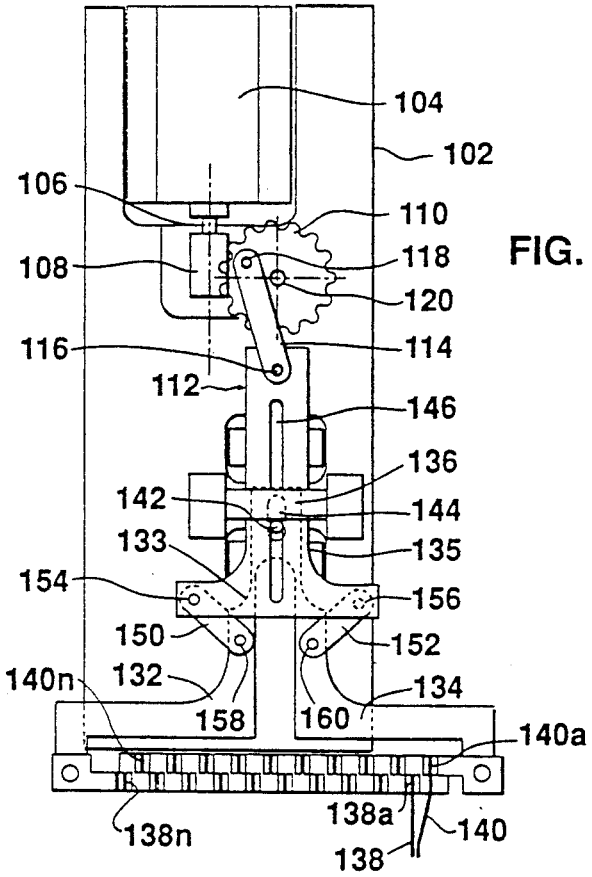
FIGS. 4*a*–4*d* illustrate the operation of the device of FIG. 3.
Figure 4B:
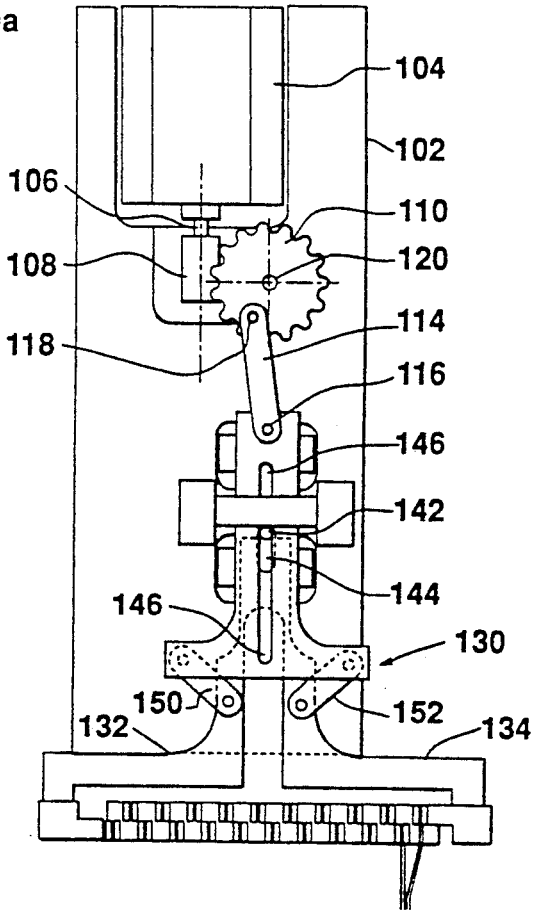
Figure 4C:
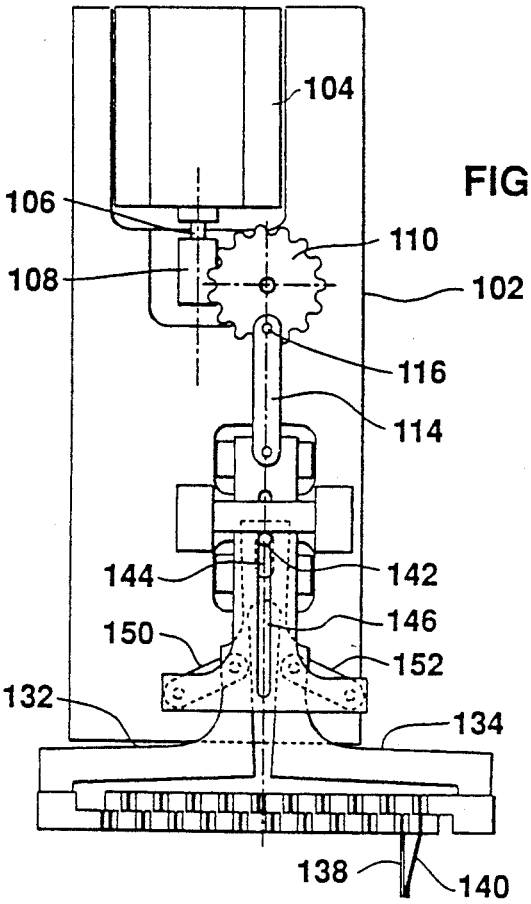
Figure 4D:
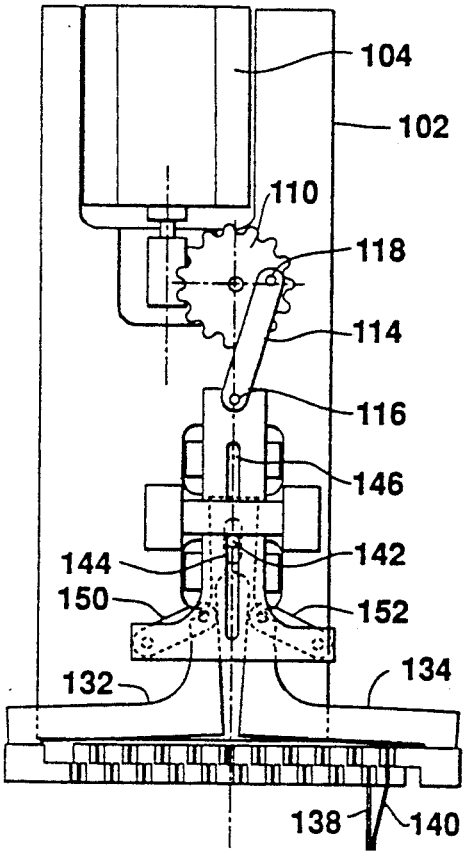

The operation of the device illustrated in FIG. 1 is shown in FIGS. 2*a*–2*d*. FIGS. 2*a* and 2*b* illustrate the movement of plate 12 through the forward stroke to an extended position, and FIGS. 2*c* and 2*d* illustrate the movement of the plate through a return stroke to its retracted position.

Thus, FIG. 2*a* illustrates the top dead-center position of the reciprocatable plate 12 at the beginning of its forward stroke. In this position, the plate is in its retracted position, and similarly the tweezers 30 is in its retracted position, but with the jaws 38, 40 of the tweezer arms in their open position. Pin 42 of the reciprocatable plate 12 is at the bottom of slot 44 formed in tweezer bridge section 36.

Assuming the eccentric 10 rotates counter-clockwise, as shown by the arrows in FIGS. 2*a*–2*d*, it will be seen that: (a) during the first-half of the forward stroke of reciprocatable plate 12, both plate 12 and the tweezers 30 are moved to their extended positions until pin 42 engages the upper end of slot 44 on the tweezers bridge section 36, which thereby arrests the downward movement of the tweezers (FIG. 2*b*); (b) during the second half of the forward stroke, plate 12 continues to move to the extended position whereby the links 50, 52, engaging the arms 32, 34 of the tweezers, move the tweezer jaws 38, 40 to their closed positions (FIG. 2*c*); (c) during the first half of the return stroke, plate 26 moves towards its retracted position with the tweezers also being moved towards the retracted position and with the tweezer jaws 38, 40 closed (FIG. 2*d*), until pin 42 engages the lower part of slot 44 (FIG. 2*d*); and (d) during the second half of the return stroke, plate 12 is moved to its fully retracted position whereupon the tweezer jaws 38, 40 are opened (FIG. 2*a*).

The Embodiment of FIGS. 3 and 4*a*–4*d*

FIGS. 3 and 4*a*–4*d* illustrate a power-operated tweezers device in which each of the pair of arms of the tweezers carries a plurality of jaws, rather than a single jaw, with all the jaws of one arm being openable and closable with respect to the jaws of the other arm.

Thus, the device of FIGS. 3 and 4*a*–4*d* includes a base 102 mounting an electric motor 104 having a rotary output shaft 106 driving a worm gear 108 meshing with a gear wheel 110. The device also includes a reciprocatable member 112 reciprocated by the motor via a crank arm 114 pivotally mounted by a pin 118 to the gear wheel 110 by a pin 118 eccentric with respect to the gear shaft 120. In this case, the base 102 includes a base plate 102*a* and a pair of side bars 102*b*, 102*c* joined at their outer ends by a crossbar 102*d*, defining a guide for guiding the reciprocations of the reciprocatable member 112. The reciprocatable member 112 is made of two sections 112, 112*b* which are moved together in unison by pin 116.

A tweezers assembly, generally designated 130, is carried by the reciprocatable member 112 and includes a pair of arms 132, 134 joined at one end by a bridge section 136, and carrying a plurality of jaws at their opposite ends.

Whereas FIGS. 4 and 4*a*–4*d* illustrate only one jaw 138, 140, carried on each of the two arms 132, 134, it will be appreciated that each of the two arms carries a plurality of jaws 138, 140, with the jaws of one arm being openable and closable with respect to the jaws of the other arm. Thus, the free ends of the two arms 132, 134 are formed with a plurality of slits 138*a*–138*n* for arm 132, and slits 140*a*–140*n* for arm 134, which slits receive their respective pincer jaws 138 and 140.

A pin 142 fixed to the base 102 on one side, and to the crossbar 102*d* on the opposite side, is received within a short slot 144 formed in the tweezers bridge section 136, and in a pair of long slots 146 formed in the two sections 112*a*, 112*b* of the reciprocatable member 112.

The two tweezer arms 132, 134 are coupled to the reciprocating member 112 by a pair of links 150, 152. Each link is pivotally mounted at one end 154, 156 to the reciprocatable member 112, and at its opposite end 158, 160 to the two arms 132, 134 of the tweezers assembly.

As in the embodiment described above with respect to FIGS. 1 and 2*a*–2*d*, slot 144 in the tweezers bridge section 136 is of substantially shorter length (e.g., one half) than the long slots 146 formed in the two sections 112*a*, 112*b* of the reciprocatable member 112. This arrangement, therefore, provides the same type of lost-motion coupling between the reciprocatable member 112 and the two arms 132, 134 of the tweezers assembly 130, to produce the same operation as described above with respect to FIGS. 2*a*–2*d*.

FIGS. 4*a*–4*d* illustrate the movements of the two tweezer arms 132, 134, and particularly their jaws 138, 140, during a complete cycle of operation of the device. In the construction illustrated in FIGS. 4 and 4*a*–4*d*, the reciprocatory movements of the reciprocatable member 112 are guided by pin 142 fixed to the base 102, and also by the two side bars 102*b*, 102*c* fixed to the base.

The two arms 132, 134 of the tweezers assembly 130 are formed with reduced-thickness sections, as shown at 133, 135, respectively, to permit the two arms to be flexed towards and away from each other when closing and opening the tweezer jaws.

While the invention has been described with respect to two preferred embodiments, it will be appreciated that many variations may be made. For example, the tweezer arms may be pivotally mounted to each other, rather than joined together by an elastic bridge section. Many other modifications and applications of the invention will be apparent.

What is claimed is:

1. A power-operated tweezers device for plucking hairs, comprising: a motor fixed with respect to a base; a reciprocatable member coupled to said motor so as to be driven through a forward stroke to an extended position, and through a return stroke to a retracted position; tweezer means including a pair of arms having jaws movable to an open position to straddle a hair to be plucked, or a closed position to clamp the hair therebetween; a lost-motion coupling between said reciprocatable member and said tweezer means effective to move the tweezer means to an extended position only during a first part of the forward stroke of the reciprocatable member, and to a retracted position only during a first part of the return stroke of the reciprocatable member; said lost-motion coupling including a pin fixed to the base and received within a long slot formed in said reciprocatable member and a short slot formed in said tweezer means; and tweezer closing-opening means effective to move the tweezer jaws to their closed positions during a last part of the forward stroke of the reciprocatable member, and to their open positions during a last part of the return stroke of the reciprocatable member.

2. The device according to claim 1, wherein said pin of the lost-motion coupling is effective to move the tweezer means to an extended position only during the first half of the forward stroke of the reciprocatable member, and to a retracted position only during the first half of the return stroke of the reciprocatable member; and said tweezer closing-opening means is effective to move the tweezer jaws to their closed positions during the last half of the forward stroke of the reciprocatable member, and to their open positions during the last half of the return stroke of the reciprocatable member.

3. The device according to claim 1, wherein each arm of said pair of arms of the tweezer means includes a single jaw.

4. The device according to claim 1, wherein each arm of said pair of arms of the tweezer means carries a plurality of jaws, the jaws of one of said arms being openable and closable with respect to the jaws of the other of said arms.

5. The device according to claim 4, wherein said tweezer closing-opening means comprises a pair of links each pivotally coupled at their outer ends to the reciprocatable member, and pivotally coupled at their inner ends to their respective arms.

6. The device according to claim 5, wherein said reciprocatable member includes a pair of reciprocatable plates secured together to move in unison between a guide fixed to the base; said pair of arms being located between said pair of plates.

7. The device according to claim 1, wherein said reciprocatable member is coupled to said motor to be cyclically reciprocated through forward strokes to an extended position, and through return strokes to a retracted position.

8. A power-operated tweezers device for plucking hairs, comprising: a motor fixed with respect to a base; a reciprocatable member coupled to said motor so as to be driven through a forward stroke to an extended position, and through a return stroke to a retracted position; tweezer means including a pair of arms having jaws movable to an open position to straddle a hair to be plucked, or a closed position to clamp the hair therebetween; a lost-motion coupling between said reciprocatable member and said tweezer means effective to move the tweezer means to an extended position only during a first part of the forward stroke of the reciprocatable member, and to a retracted position only during a first part of the return stroke of the reciprocatable member; and tweezer closing-opening means effective to move the tweezer jaws to their closed positions during a last part of the forward stroke of the reciprocatable member, and to their open positions during a last part of he return stroke of the reciprocatable member; said motor being a rotary motor having a rotary shaft and being coupled to said reciprocatable member by an eccentric rotated by said rotary shaft; said rotary shaft rotating a worm gear meshing with a gear wheel eccentrically coupled to said reciprocatable member.

9. A power-operated tweezers device for plucking hairs, comprising: a motor fixed with respect to a base; a reciprocatable member coupled to said motor so as to be driven through a forward stroke to an extended position, and through a return stroke to a retracted position; tweezer means including a pair of arms having jaws movable to an open position to straddle a hair to be plucked, or a closed position to clamp the hair therebetween; a lost-motion coupling between said reciprocatable member and said tweezer means effective to move the tweezer means to an extended position only during a first part of the forward stroke of the reciprocatable member, and to a retracted position only during a first part of the return stroke of the reciprocatable member; and tweezer closing-opening means effective to move the tweezer jaws to their closed position during a last part of the forward stroke of the reciprocatable member, and to their open positions during a last part of the return stroke of the reciprocatable member; said reciprocatable member being a reciprocatable plate movable on said base and constrained to reciprocal movements by pins fixed to said base movable in slots formed in said plate.

10. The device according to claim 9, wherein said tweezer closing-opening means comprises a pair of links pivotally mounted at their outer ends to said reciprocatable plate and coupled at their inner ends to said arms of the tweezer means.

11. A power-operated tweezers device for plucking hairs, comprising: a motor carried by a base and having a rotary shaft; a reciprocatable member coupled to said motor by an eccentric rotated by said rotary shaft so as to be cyclically driven through a forward stroke to an extended position, and through a return stroke to a retracted position; tweezer means including a pair of arms having jaws movable to an open position, or a closed position; a lost-motion coupling between the reciprocatable member and the tweezer means, including a pin fixed to the base and received within a long slot formed in the reciprocatable member and a short slot formed in the tweezer means, effective to move the tweezer means to an extended position only during a first part of the forward stroke of the reciprocatable member, and to a retracted position only during a first part of the return stroke of the reciprocatable member; and tweezer closing-opening means effective to move the tweezer jaws to their closed positions during a last part of the forward stroke of the reciprocatable member, and to their open positions during a last part of the return stroke of the reciprocatable member.

12. The device according to claim 11, wherein said rotary shaft rotates a worm gear meshing with a gear wheel eccentrically coupled to said reciprocatable member.

13. The device according to claim 11, wherein said reciprocatable member is a reciprocatable plate movable on said base and constrained to reciprocal movements by pins fixed to said base movable in slots formed in said plate.

14. The device according to claim 11, wherein each arm of said pair of arms of the tweezer means includes a single jaw.

15. The device according to claim 11, wherein each arm of said pair of arms of the tweezer means carries a plurality of jaws, the jaws of one of said arms being openable and closable with respect to the jaws of the other of said arms.

16. The device according to claim 15, wherein said tweezer closing-opening means comprises a pair of links each pivotally coupled at their outer ends to the reciprocatable member, and pivotally coupled at their inner ends to their respective arms.

17. The device according to claim 16, wherein said reciprocatable member includes a pair of reciprocatable plates secured together to move in unison between a guide fixed to the base; said pair of arms being located between said pair of plates.

* * * * *